US007014567B2

(12) United States Patent
Wang

(10) Patent No.: US 7,014,567 B2
(45) Date of Patent: Mar. 21, 2006

(54) GOLF CLUB HEAD

(75) Inventor: Ma-Li Wang, Taipei (TW)

(73) Assignee: Grad Star Resources Ltd., Taipei (TW)

( * ) Notice: Subject to any disclaimer, the term of this patent is extended or adjusted under 35 U.S.C. 154(b) by 142 days.

(21) Appl. No.: 10/686,434

(22) Filed: Oct. 14, 2003

(65) Prior Publication Data

US 2005/0009628 A1 Jan. 13, 2005

(30) Foreign Application Priority Data

Jul. 10, 2003 (TW) ..... 92212641 U

(51) Int. Cl.
*A63B 69/36* (2006.01)
*A63B 53/04* (2006.01)

(52) U.S. Cl. ..... 473/251; 473/252; 473/330; 473/340

(58) Field of Classification Search ..... 473/340–341, 473/249–252, 330–331, 286, 313, 265, 235; D21/736–746
See application file for complete search history.

(56) References Cited

U.S. PATENT DOCUMENTS 1,877,820 A * 9/1932 Costello ..... 473/235
2,094,766 A * 10/1937 Costello ..... 473/138
D232,371 S * 8/1974 Becker ..... D21/741
3,881,733 A * 5/1975 Csernits ..... 473/330
3,954,265 A * 5/1976 Taylor ..... 473/252
4,248,430 A * 2/1981 Kepler ..... 473/285
4,290,606 A * 9/1981 Maxwell ..... 473/569
4,650,191 A * 3/1987 Mills ..... 473/341
4,846,477 A * 7/1989 Phelan ..... 473/330
4,962,931 A * 10/1990 Jazdzyk, Jr. ..... 473/252
5,090,703 A * 2/1992 Koumarianos ..... 473/328
5,476,262 A * 12/1995 Bandiero ..... 473/409
5,690,556 A * 11/1997 Condon ..... 473/252
6,503,151 B1 1/2003 Kosovac

FOREIGN PATENT DOCUMENTS

TW 525520 3/2003

* cited by examiner

*Primary Examiner*—Sebastiano Passaniti
(74) *Attorney, Agent, or Firm*—Fulbright & Jaworski LLP

(57) ABSTRACT

A golf club head for use in a putter includes: a body having a top and a bottom, an aligning portion formed on the top of the body, and a striking portion having a cavity and formed on the bottom of the body. By using the aligning portion to align a golf ball with an intended movement path toward a target hole, the golf ball can be hit by the striking portion to move along the intended path toward the target hole.

9 Claims, 2 Drawing Sheets

GOLF CLUB HEAD

FIELD OF THE INVENTION

The present invention relates to golf club heads, and more particularly, to a club head of a golf putter to improve the performance and posture of a golfer when playing golf.

BACKGROUND OF THE INVENTION

It is well recognised that putting is usually considered as the determining factor of victory or defeat in a golf game. Putting is implemented by combination of feeling, tactile sensations, and experience. During putting, in order to allow a golf ball to reach a target hole, a golfer must operate a putter to strike and propel the golf ball accurately that is urged to move in an optimal topspin motion toward the target hole on the green in such a way that the putter face striking the ball is perpendicular to an intended movement path of the ball toward the target.

FIG. 4 shows a common club head 10 of a golf putter. The club head 10 comprises a top portion 101, a bottom portion 103 and a recessed portion 105. The top portion 101 of the club head 10 further comprises a slot (not shown) for accommodating a shaft 12 of the putter that is thus connected with the club head 10.

However, it is actually not easy for the golfer to strike the ball with the striking face of the putter head being precisely perpendicular to the intended movement path of the golf ball. Moreover, the putter may usually not be exerted with sufficient force from the golfer, making the movement of the putter head slow down before striking the ball. When the ball is hit by the striking face of such a putter head, it fails to move along the intended movement path to reach the target hole.

Accordingly, Taiwan Patent Publication No. 525520 and U.S. Pat. No. 6,503,151 respectively propose a solution to the foregoing problem.

Taiwan Patent Publication No. 525520 discloses an aligning apparatus disposed and engaged between a handle and a shaft of a putter by a fixing means. The fixing means is pivotally formed with a laser projecting means capable of swinging upwardly and downwardly to cast an aligning line on the ground.

However, as the above laser aligning apparatus requires installation of delicate electronic elements, its fabrication cost and assembly preciseness are both increased. Further, this laser aligning apparatus is not only easily damaged during operation of the putter for example when striking a golf ball, but also not cost-effective to use as having to pay for extra power supplied to the laser projecting means that is electrically driven.

U.S. Pat. No. 6,503,151 discloses a golf club having a club head comprising a mass-concentrated elongated body whose bottom surface is formed with a recessed portion thereon having a longitudinal dimension smaller than one and half ball diameter. A V-shaped groove is provided on a top surface of the elongated body corresponding in position to the recessed portion and serves as a guide for aligning a golf ball that is to be hit by a striking face i.e. a side surface of the elongated body connected to both the recessed portion and the V-shaped portion.

However, it is relatively difficult to accurately align the striking face of the above golf club with the center of the golf ball, making the ball not easily controlled to move toward the target hole. Further due to the difficult alignment with respect to the ball center, a golfer who operates the club would be hard to apply appropriate force to the club for striking the ball. In such a case, the golfer who usually fails to strike the ball successfully may not improve or correct the posture and habit of playing golf thereof.

Therefore, in response to the above-mentioned drawbacks, the problem to be solved herein is to provide a golf club head which would not undesirably increase fabrication costs thereof while allows a golfer using this club head to easily align and hit a golf ball and improve the golf-playing posture thereof.

SUMMARY OF THE INVENTION

A primary objective of the present invention is to provide a golf club head for use in a putter, which allows a golfer using this club head to correct or improve the golf-playing posture thereof and easily strike or move a golf ball toward an intended target hole.

In order to achieve the foregoing and other objectives, the present invention proposes a golf club head for use in a putter, comprising: a body having a top surface and a bottom surface; an aligning portion formed on the top surface of the body and having an indicative means for aligning the golf ball with an intended movement path toward the target hole; and a striking portion formed on the bottom surface of the body and having a cavity formed therein, for striking the golf ball to move along the intended path by the alignment of the aligning portion.

The cavity of the striking portion is sized sufficient to receive the golf ball. Once the golf ball enters the cavity, a golfer who operates the club head can align the indicative means of the aligning portion with the golf ball and toward the target hole, such that the ball is allowed to be hit by an intended striking face of the striking portion that is perpendicular to the intended movement path toward the target and move from the cavity toward the target hole along the intended path. Otherwise, if the golfer fails to align the indicative means of the aligning portion with the golf ball and toward the target hole, the ball would not be hit by the intended striking face of the striking portion, making the movement of the ball not along the intended path toward the target; this informs the golfer that the playing posture thereof is required being adjusted.

Accordingly, the golfer is able to use the proposed club head to practice and adjust his/ her posture until the indicative means of the aligning portion can be aligned with the golf ball and toward the target hole so as to allow the golf ball to be hit by the intended striking face of the striking portion and move toward the target.

Therefore, in the use of the golf club head for a putter according to the invention, it would be easy for a golfer who operates the putter to accurately align the club bead with a golf ball in a manner that an intended striking face of the club head is perpendicular to an intended movement path of the ball toward the target, such that the ball can be hit by the intended striking face to move to the target. This allows the golfer to easily adjust or correct the golf-playing posture thereof to more successfully push or propel the ball toward the target by means of the putter having the proposed club head. Moreover, the club head according to the invention is cost-effectively fabricated without requiring delicate electronic elements and thereby free of concern of difficulty or complexity in assembly, manufacture and usage.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENTS

The preferred embodiment for a gold club head proposed by the present invention is described in detail with reference to FIGS. 1 to 3. As shown, the golf cub head 1 particularly used in a putter comprises a body 11, an aligning portion 13, and a striking portion 15.

The golf club head 1 can be designed as a conventional D-type club head having a thicker bottom. Since the inclination, length, and weight (dependent on the fabrication materials) of a club head are well known in the art and thus not to be further discussed herein.

Figure 1:
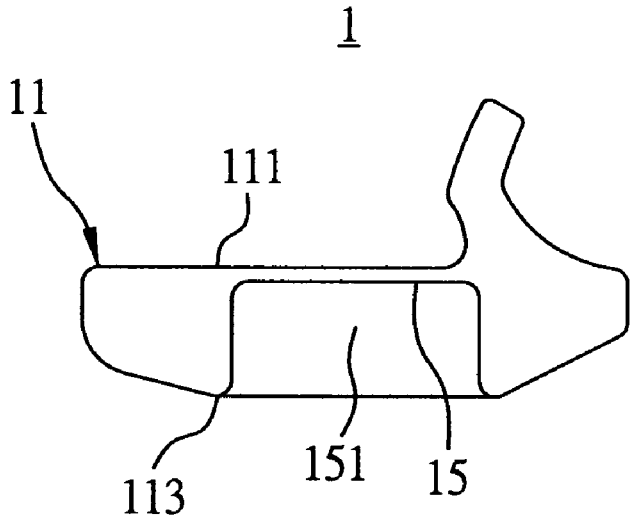
FIG. 1 is a side view of a golf club head according to a preferred embodiment of the invention.

Referring to FIG. 1, the body 11 of the club head 1 is formed with a top surface 111 and a bottom surface 113, wherein the top surface 11 is substantially flat while the bottom surface 113 has the conventional inclination.

Figure 2:
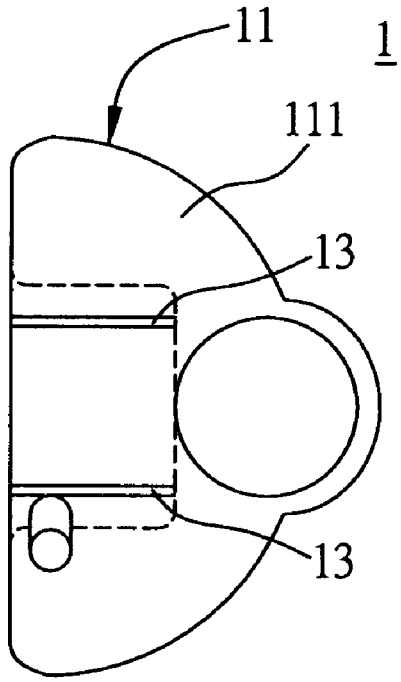
FIG. 2 is a top view of the golf club head according to the preferred embodiment of the invention.

Referring to FIG. 2, the aligning portion 13 is formed on the top surface 111 of the body 11 and has an indicative means for aligning a golf ball (not shown) with an intended movement path toward a target hole, wherein the indicative means is substantially parallel to the intended movement path of the ball, so as to allow a striking face of the club head 1 to be perpendicular to the intended movement path of the ball, such that the ball hit by the striking face can move toward the target hole along the intended path. As shown, the indicative means of the aligning portion 13 comprises two parallel straight lines that are spaced apart by a distance slightly smaller than the diameter of a standard golf ball.

It should be understood that besides the above two straight lines, the indicative means of the aligning portion 13 may comprise three parallel straight lines among which the two farthest lines are spaced apart by a distance slightly smaller than or equal to the ball diameter. Alternatively, the indicative means may also be at least one indicative line of various shape (such as arrow), indicative element (such as protrusion), or indicative pattern (such as spherical pattern), etc.

Figure 3:
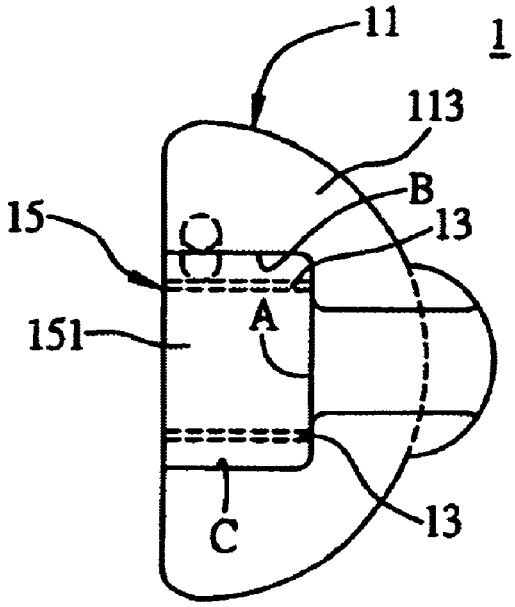
FIG. 3 is a bottom view of the golf club head according to the preferred embodiment of the invention.
Figure 4:
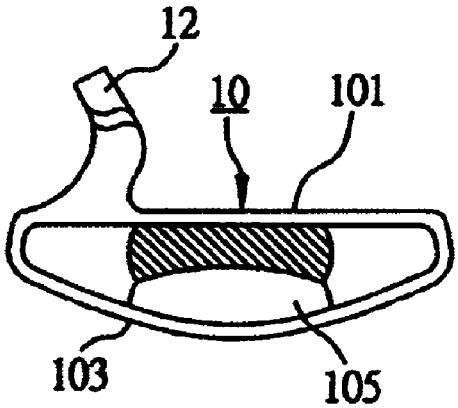
FIG. 4 Prior Art
FIG. 4 (PRIOR ART) is a side view of a conventional golf club head.

Referring to FIG. 3, the striking portion 15 is formed on the bottom surface 113 of the body 11. The striking portion 15 comprises a cavity 151 sized for accommodating a standard golf ball. In this embodiment, the striking portion 15 and the cavity 151 are shaped substantially as a square. It should be understood that the striking portion 15 and the cavity 151 can be flexibly dimensioned and configured; for example, the striking portion 15 may have a hemispherical cavity (not shown) to receive the golf ball.

The cavity 151 of the striking portion 15 is encompassed by at least three faces comprising: a first striking face A, a second striking face B, and a third striking face C, wherein the first striking face A is the intended face to strike the golf ball. When the golf ball enters the cavity 151, a golfer who operates the club head 1 can align the indicative means of the aligning portion 13 with the golf ball and toward the target hole, such that the ball is allowed to be hit by the first striking face A that is perpendicular to the intended movement path toward the target and move from the cavity 151 toward the target hole along the intended path.

In other cases, if the golfer fails to align the indicative means of the aligning portion 13 with the golf ball and toward the target hole, the ball may be hit by the second striking face B or third striking face C that is not perpendicular to the intended movement path toward the target, making the ball not able to move from the cavity 151 toward the target hole along the intended path.

Therefore, in the use of the golf club head for a putter according to the invention, it would be easy for a golfer who operates the putter to accurately align the club head with a golf ball in a manner that an intended striking face of the club head is perpendicular to an intended movement path of the ball toward the target, such that the ball can be hit by the intended striking face to move to the target. This allows the golfer to easily adjust or correct the golf-playing posture thereof to more successfully push or propel the ball toward the target by means of the putter having the proposed club head. Moreover, the club head according to the invention is cost-effectively fabricated without requiring delicate electronic elements and thereby free of concern of difficulty or complexity in assembly, manufacture and usage.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A golf club head for use in a putter that is to move a golf ball toward a target hole, toward a target hole, comprising:

a body having a top surface and an opposing bottom surface;

an aligning portion formed on the top surface of the body and having an indicative means for aligning the golf ball with an intended movement path toward the target hole; and a striking portion formed beneath the top surface and within a cavity formed on the body, for striking the golf ball to move along the intended movement path by the alignment of the aligning portion, wherein the cavity of the striking portion is encompassed by at least three faces comprising a first striking face, a second striking face, and a third striking face, such that the golf ball hit by the first striking face is capable of moving along the intended movement path toward hole, while the golf ball hit by the second or third striking face fails to move along the intended movement path, and wherein the cavity of the striking portion is shaped substantially as a square.

2. The golf club head of claim 1, wherein the golf club head is a D-type club head.

3. The golf club head of claim 1, wherein the alignment of the aligning portion allows a striking face of the striking portion that hits the golf ball to be perpendicular to the intended movement path of the golf ball toward the target hole.

4. The golf club head of claim 1, wherein the indicative means of the aligning portion is parallel to the intended movement path of the golf ball.

5. The golf club head of claim 1, wherein the indicative means comprises at least one indicative line.

6. The golf club head of claim 5, wherein the indicative means comprises two parallel straight lines.

7. The golf club head of claim 1, wherein the indicative means comprises at least one indicative element.

8. The golf club head of claim 1, wherein the indicative means comprises at least one indicative pattern.

9. The golf club head of claim 1, wherein the cavity of the striking portion is sized sufficient to receive the golf ball.

* * * * *